US006848207B1

(12) United States Patent
Powell

(10) Patent No.: US 6,848,207 B1
(45) Date of Patent: Feb. 1, 2005

(54) IDENTIFICATION BADGE ASSEMBLY

(76) Inventor: Cynthia L. Powell, 5327 Bosworth Ave., Baltimore, MD (US) 21207

( * ) Notice: Subject to any disclaimer, the term of this patent is extended or adjusted under 35 U.S.C. 154(b) by 66 days.

(21) Appl. No.: 10/368,029

(22) Filed: Feb. 19, 2003

(51) Int. Cl.[7] ..... G09F 3/18

(52) U.S. Cl. ..... 40/661; 40/654.01; 40/586; 283/75; 224/600; 224/623; 224/257

(58) Field of Search ..... 40/661, 649, 654.01, 40/586; 283/75, 108, 109; 150/147, 148, 145, 149; 206/39; 224/191, 600, 623, 230, 683, 684, 249, 257

(56) References Cited

U.S. PATENT DOCUMENTS

| | | | | | |
|---|---|---|---|---|---|
| 1,153,094 | A | * | 9/1915 | McGinty | 40/661.06 |
| 2,544,618 | A | * | 3/1951 | Smith | 40/661.04 |
| 3,216,135 | A | | 11/1965 | Wright | |
| 3,295,235 | A | * | 1/1967 | Tauber | 40/1.5 |
| 3,371,829 | A | * | 3/1968 | Phillips | 224/230 |
| 3,999,317 | A | * | 12/1976 | Owens | 40/1.5 |
| D252,355 | S | * | 7/1979 | Uber | D3/226 |
| 4,259,797 | A | * | 4/1981 | Belser | 40/1.5 |
| 4,509,277 | A | | 4/1985 | Bolton | |
| D279,692 | S | | 7/1985 | Silkebakken et al. | |
| D332,803 | S | | 1/1993 | Forslund | |
| 5,873,606 | A | | 2/1999 | Haas et al. | |
| 6,086,707 | A | * | 7/2000 | Waller | 156/277 |
| 6,108,957 | A | * | 8/2000 | Zapawa | 40/654.01 |
| 6,226,905 | B1 | | 5/2001 | Osuna | |
| D479,647 | S | * | 9/2003 | Paura et al. | D3/215 |
| 6,681,972 | B1 | * | 1/2004 | Tapocik | 224/602 |
| 2002/0153400 | A1 | * | 10/2002 | Chase et al. | 224/610 |
| 2003/0080549 | A1 | * | 5/2003 | Tischer | 283/75 |
| 2003/0188815 | A1 | * | 10/2003 | Hart | 150/147 |
| 2003/0201293 | A1 | * | 10/2003 | Hansen et al. | 224/600 |
| 2004/0040194 | A1 | * | 3/2004 | Arraut | 40/654.01 |

* cited by examiner

*Primary Examiner*—Gary C. Hoge

(57) ABSTRACT

An identification badge assembly for identifying products and employees. The identification badge assembly includes a holder assembly including a support member having a main wall, and also including a pouch being attached to a front side of the main wall, and further including writing utensil holders being attached to the front side of the main wall, and also including an eyeglass support member being attached to the main wall; and also includes a neck strap being attached to the support member and being adapted to be worn about a user's neck; and further includes an identification card having a front side and also having indicia displayed upon the front side thereof; and also includes product samples including pills and capsules being attached to the front side of the identification card.

7 Claims, 2 Drawing Sheets

IDENTIFICATION BADGE ASSEMBLY

BACKGROUND OF THE INVENTION

1. Field of the Invention

The present invention relates to company badges and more particularly pertains to a new identification badge assembly for identifying products and employees.

2. Description of the Prior Art

The use of company badges is known in the prior art. More specifically, company badges heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,509,277; U.S. Pat. No. 6,226,905; U.S. Pat. No. 5,873,606; U.S. Pat. No. 3,216,135; U.S. Pat. No. Des. 332,803; and U.S. Pat. No. Des. 279,692.

While these devices fulfill their respective, particular objectives and requirements, the aforementioned patents do not disclose a new identification badge assembly. The prior art includes badges identifying the wearer's name and also includes pouches for carrying items.

SUMMARY OF THE INVENTION

The general purpose of the present invention, which will be described subsequently in greater detail, is to provide a new identification badge assembly which has many of the advantages of the company badges mentioned heretofore and many novel features that result in a new identification badge assembly which is not anticipated, rendered obvious, suggested, or even implied by any of the prior art company badges, either alone or in any combination thereof. The present invention includes a holder assembly including a support member having a main wall, and also including a pouch being attached to a front side of the main wall, and further including writing utensil holders being attached to the front side of the main wall, and also including an eyeglass support member being attached to the main wall; and also includes a neck strap being attached to the support member and being adapted to be worn about a user's neck; and further includes an identification card having a front side and also having indicia displayed upon the front side thereof; and also includes product samples including pills and capsules being attached to the front side of the identification card. None of the prior art includes the combination of the elements of the present invention.

There has thus been outlined, rather broadly, the more important features of the identification badge assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new identification badge assembly which has many of the advantages of the company badges mentioned heretofore and many novel features that result in a new identification badge assembly which is not anticipated, rendered obvious, suggested, or even implied by any of the prior art company badges, either alone or in any combination thereof.

Still another object of the present invention is to provide a new identification badge assembly for identifying products and employees.

Still yet another object of the present invention is to provide a new identification badge assembly that is easy and convenient to set up and use.

Even still another object of the present invention is to provide a new identification badge assembly that allows the user to quickly access the products and make one's presentation of the products much simpler and cleaner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
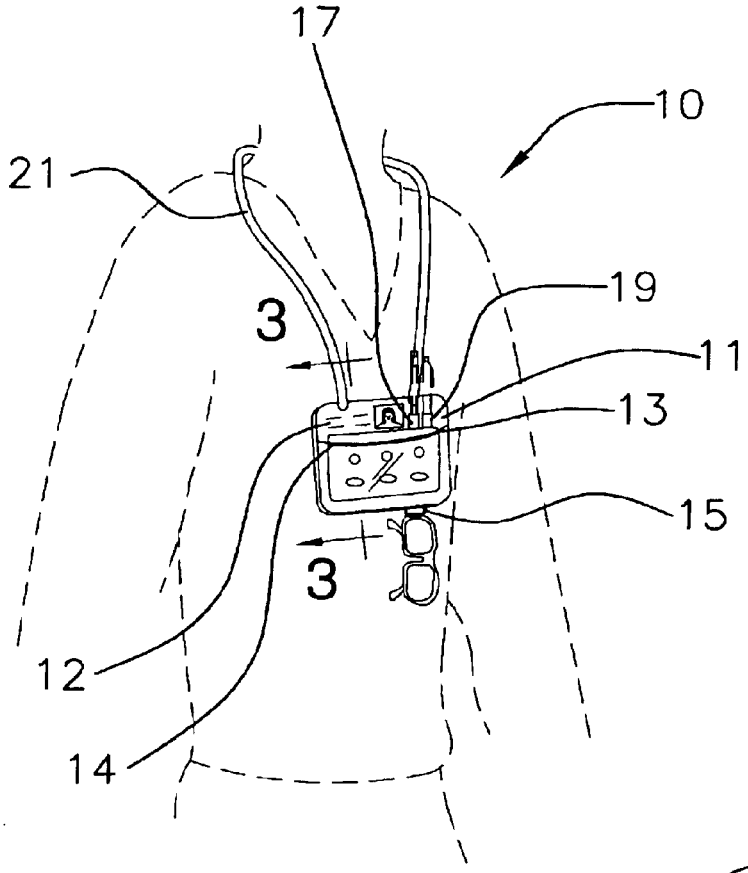
FIG. 1 is a perspective view of a new identification badge assembly according to the present invention.
Figure 3:
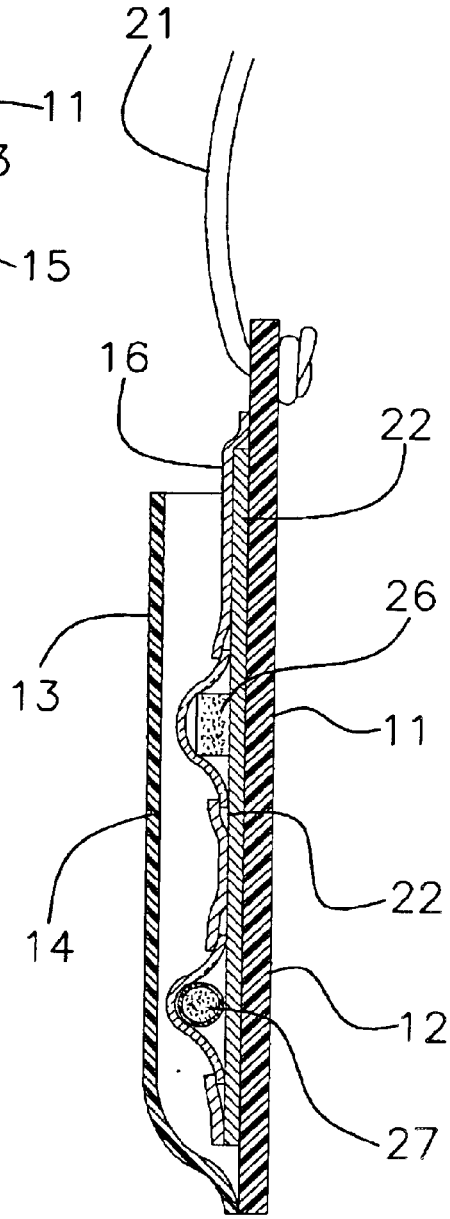
FIG. 3 is a cross-sectional view of the present invention.
Figure 2:
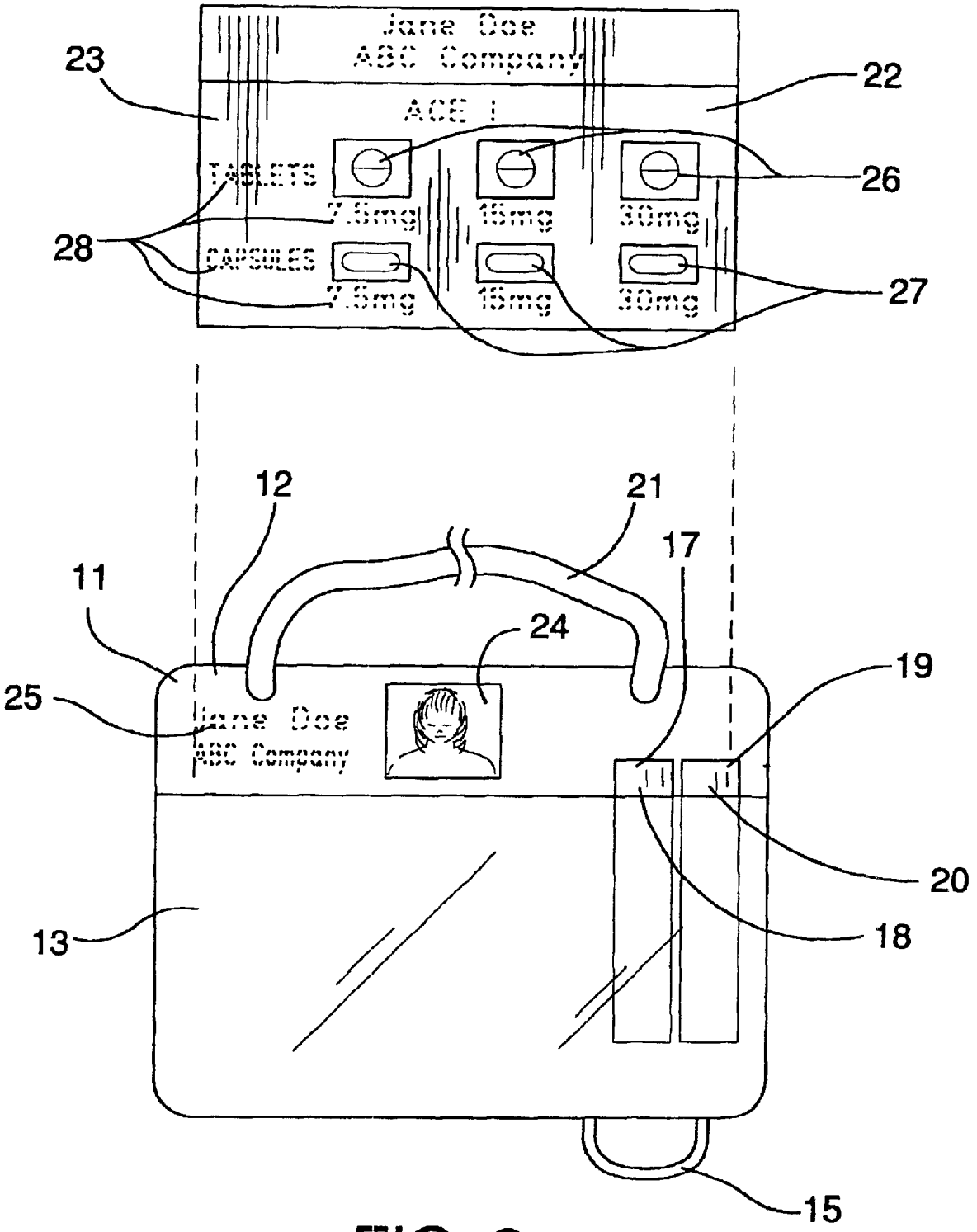
FIG. 2 is an exploded perspective view of the present invention.

With reference now to the drawings, and in particular to FIGS. 1 through 3 thereof, a new identification badge assembly embodying the principles and concepts of the present invention and generally designated by the reference numeral 10 will be described.

As best illustrated in FIGS. 1 through 3, the identification badge assembly 10 generally comprises a holder assembly including a support member 11 having a main wall 1, and also including a pouch 13 being conventionally attached to a front side of the main wall 12, and further including writing utensil holders 17,19 being conventionally attached to the front side of the main wall 12, and also including an eyeglass support member 15 being conventionally attached to the main wall 12. The holder assembly further includes a transparent flap 16 being conventionally disposed in the pouch 13. The pouch 13 includes a portion of the main wall 12 of the support member 11 and also includes a piece of material 14 having side and bottom edges which are securely and conventionally attached to side and bottom edges of the portion of the main wall 12 of the support member 11. Each of the writing utensil holders 17,19 includes a portion of the main wall 12 of the support member 11 and also includes a piece of material 18,20 having side and bottom edges which are securely and conventionally attached to the portion of the main wall 12 of the support member 11 and being adapted to support a pen/pencil therein through an open top thereof. The eyeglass support member 15 is an opening along the bottom edge of the main wall 12 of the support member 11 for supporting a user's eyeglasses. The holder assembly also includes identification indicia including a photograph 24 of the user and also the user's name 25 being conventionally displayed upon the top portion of the front side of the main wall 12 of the support member 11.

A neck strap 21 is conventionally attached to the support member 11 and is adapted to be worn about a user's neck. The neck strap 21 includes end portions which are disposed through a top portion of the main wall 12 of the support member 11.

A product identification card 22 has a front side 23 and also has product indicia 28 being conventionally displayed upon the front side 23 thereof. Product samples 26,27 including pills and capsules are conventionally attached to the front side 23 of the product identification card 22. The product samples 26,27 and the identification card 22 are removably disposed in the pouch 13 with the transparent flap 16 being removably and clingingly attached upon the front side 23 of the product identification card 22 and upon the product samples 26,27.

In use, the user would hang the holder assembly about one's neck using the neck strap 21, and would be able to readily access the product identification card 22 by removing it from the pouch 13 and would be able to display the product samples 26,27 attached to the front side 23 of the product identification card 22. Once finished, the user can insert the product identification card 22 back into the pouch 13 and place the transparent flap 16 over the product samples 26,27 and the product identification card 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the identification badge assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An identification badge assembly comprising:

a holder assembly including a support member having a main wall, and also including a pouch being attached to a front side of said main wall, and further including writing utensil holders being attached to said front side of said main wall, and also including an eyeglass support member being attached to said main wall;

a neck strap being attached to said support member and being adapted to be worn about a user's neck;

a product identification card having a front side and also having product indicia displayed upon said front side thereof; and product samples including pills and capsules being attached to said front side of said product identification card.

2. An identification badge assembly as described in claim 1, wherein said holder assembly further includes a transparent flap being disposed in said pouch and having a bottom edge which is securely attached to said front side of said main wall of said support member; and also includes identification indicia including a photograph of the user and also the user's name being displayed upon said top portion of said front side of said main wall of said support member.

3. An identification badge assembly as described in claim 2, wherein said pouch includes a portion of said main wall of said support member and also includes a piece of material having side and bottom edges which are securely attached to side and bottom edges of said portion of said main wall of said support member.

4. An identification badge assembly as described in claim 3, wherein each of said writing utensil holders includes a portion of said main wall of said support member and also includes a piece of material having side and bottom edges which are securely attached to said portion of said main wall of said support member and being adapted to support a pen/pencil therein through an open top thereof.

5. An identification badge assembly as described in claim 4, wherein said neck strap includes end portions which are disposed through a top portion of said main wall of said support member.

6. An identification badge assembly as described in claim 5, wherein said eyeglass support member is an opening along said bottom edge of said main wall of said support member for supporting a user's eyeglasses.

7. An identification badge assembly as described in claim 6, wherein said product samples and said product identification card are removably disposed in said pouch with said transparent flap being removably and clingingly attached upon said front side of said product identification card and upon said product samples.

* * * * *